US006742861B2

(12) United States Patent
McCarty

(10) Patent No.: US 6,742,861 B2
(45) Date of Patent: Jun. 1, 2004

(54) INK DELIVERY SYSTEM FOR A MINIATURE INKJET PEN

(75) Inventor: Mark L McCarty, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/208,956

(22) Filed: Jul. 30, 2002

(65) Prior Publication Data

US 2004/0021725 A1 Feb. 5, 2004

(51) Int. Cl.[7] ..... B41J 2/165

(52) U.S. Cl. ..... 347/29; 347/85; 347/86; 347/89

(58) Field of Search ..... 347/29, 7, 30, 347/35, 85, 86, 89, 92

(56) References Cited

U.S. PATENT DOCUMENTS

| | | | | |
|---|---|---|---|---|
| 4,791,438 A | * | 12/1988 | Hanson et al. | 347/87 |
| 4,968,998 A | | 11/1990 | Allen | |
| 5,105,205 A | * | 4/1992 | Fagerquist | 347/90 |
| 5,719,608 A | | 2/1998 | Sabonis et al. | |
| 5,757,406 A | | 5/1998 | Kaplinsky et al. | |
| 5,774,154 A | | 6/1998 | Underwood | |
| 5,841,454 A | | 11/1998 | Hall et al. | |
| 5,870,125 A | | 2/1999 | Swanson et al. | |
| 5,886,718 A | | 3/1999 | Johnson et al. | |
| 5,905,518 A | | 5/1999 | DeFilippis | |
| 5,936,650 A | * | 8/1999 | Ouchida et al. | 347/89 |
| 6,010,759 A | | 1/2000 | Yamada et al. | |
| 6,137,512 A | | 10/2000 | Higuma et al. | |
| 6,190,007 B1 | * | 2/2001 | Taylor et al. | 347/84 |
| 6,249,655 B1 | | 6/2001 | Baek et al. | |
| 6,276,778 B1 | * | 8/2001 | Katayama | 347/28 |
| 6,312,116 B2 | | 11/2001 | Underwood et al. | |
| 6,324,370 B1 | | 11/2001 | Isobe et al. | |
| 6,345,891 B1 | * | 2/2002 | Childers et al. | 347/87 |
| 6,347,865 B1 | | 2/2002 | Matsumoto et al. | |
| 6,394,591 B1 | | 5/2002 | Higuma et al. | |
| 6,394,593 B1 | | 5/2002 | Komplin et al. | |

OTHER PUBLICATIONS

Lyman, J, "Pocket–Sized Sony Picture Printer Boon for Digital Photos" (2 pages), [online] Part of the NewsFactor Network, Aug. 31, 2001 [retrieved on May 29, 2002 from the Internet: http://www.newsfactor.com/pert/printer/13250.html].

Romanc, V., "Hewlett Packard Photosmart 100 Print Review" (22 pages), [online] Retrieved on May 29, 2002 from the Internet: http://www.digit–life.com/articles/hpps100].

* cited by examiner

*Primary Examiner*—Shih-Wen Hsieh

(57) ABSTRACT

An ink delivery device is provided for supplying ink via an ink conduit from an ink supply to a print head attached to a manifold, the manifold adapted to route ink into the print head and back to the ink conduit for routing to the ink supply. The ink delivery device comprises a pressure controller operating on the ink conduit between the print head and the ink supply, the pressure controller including a sealing device adapted to seal off the ink conduit and a cap adapted to selectably expose the pressure controller to ambient conditions. The pressure controller is adapted to purge the print head of ink between print jobs.

37 Claims, 7 Drawing Sheets

INK DELIVERY SYSTEM FOR A MINIATURE INKJET PEN

FIELD OF THE INVENTION

The present invention relates generally to the field of ink jet printers, and more particularly, to ink delivery systems for pen designs.

BACKGROUND OF THE INVENTION

Many conventional ink jet printers use an integrated print head and ink supply configuration in a single ink jet cartridge. One such exemplary integrated cartridge is the tricolor Hp cartridge 51625A, for use in the Hp Deskjet 560 printer. In the Hp Deskjet 560 printer, a cartridge is replaced whenever an ink supply is exhausted. Replacing the entire cartridge, however, is relatively expensive, as the print head adds substantial cost to the integrated cartridge even though it often does not need to be replaced every time the ink supply is spent.

Some conventional ink jet printers have been developed with a separated print head and ink supply configuration to reduce the cost of replacement cartridges. These configurations are typically described as having a semi-permanent and reusable "pen body" and print head mechanism supplied with ink from a remote, off-axis (or off-board) ink reservoir (i.e., ink supply). Exemplary systems are described in U.S. Pat. No. 5,757,406 ("Negative pressure ink delivery system") and U.S. Pat. No. 5,886,718 ("Ink-jet off axis ink delivery system"). In such systems, an individual ink supply for the printer (e.g., a magenta ink container) is replaced or refilled whenever that particular ink supply is exhausted. Replacing individual ink supplies correspondingly reduces the recurring costs by eliminating the need to replace the print head along with the ink supply every time an ink supply is spent. Separated print head and ink supply configurations, however, still suffer from many problems.

Conventional ink jet pens (including both integrated and separated print head/ink supply configurations) are typically made of an amorphous material (e.g., various plastics), to reduce the materials cost of the print head. Depending on the particular pen configuration and material used, however, residual ink within the pen undergoes water evaporation over time, especially during lulls between print jobs which can last for several days (e.g., over a weekend). As water slowly evaporates from the ink, the ink properties (e.g., viscosity, color tone, etc.) change, thereby degrading the ink quality and correspondingly, the printer performance on subsequent print jobs.

Unlike large conventional "bookshelf" printers, many new printer applications involve relatively small printers (e.g., digital camera printers, palmtop printers, calculator printers, laptop printers, etc.). One such printer is the Hp Photosmart 100, which is approximately 218×108×115 mm. These printers are designed to print on media generally less than about 100 mm in width.

Some problems suffered by conventional printers, such as water evaporation, are amplified in small printers (in comparison to standard "book shelf" printers), because the size of the print head and ink supply components shrink corresponding to the overall reduced printer size. By way of example, a 100 cc ink supply (e.g., a "book shelf" printer ink supply) suffering from a 1 cc loss in water due to evaporation still has 99 cc of ink at a $^{99}/_{100}$ (i.e., 99%) purity. In contrast, a 10 cc ink supply (e.g., a small printer) suffering from a 1 cc loss in water due to evaporation has only 9 cc of ink at a $^{9}/_{10}$ (i.e., 90%) purity, a 9% greater reduction in purity than that of the 100 cc ink supply. Hence, as the printer size shrinks, the water loss problem is substantially increased, which leads to greater problems in degraded ink properties and printer performance.

Furthermore, as water evaporates from a printer, it is generally exchanged with air. Air pockets and/or air bubbles can form in the ink supply, along ink conduits between the ink supply and the print head, or even within the print head itself in areas such as ink cavities behind each ink jet nozzle. With smaller printers, these air pockets and/or air bubbles lead to significant printing inconsistencies, such as varying pressure within the system, interrupted ink delivery from the ink supply to the print head, and other such problems.

Thus, a need exists for an improved ink delivery system, and in particular, for an improved ink delivery system for miniature pen designs.

SUMMARY OF THE INVENTION

According to one embodiment of the present invention, an ink delivery device is provided for supplying ink via an ink conduit from an ink supply to a print head attached to a manifold, the manifold adapted to route ink into the print head and back to the ink conduit for routing to the ink supply. The ink delivery device comprises a pressure controller operating on the ink conduit between the print head and the ink supply, the pressure controller including a sealing device adapted to seal off the ink conduit and a cap adapted to selectably expose the pressure controller to ambient conditions. The pressure controller is adapted to purge the print head of ink between print jobs.

According to another embodiment of the present invention, a method of delivering ink to an ink applicator system including an ink applicator is provided comprising the steps of priming the ink applicator prior to printing, and purging the system after printing to remove ink from the ink applicator system, wherein the backpressure within the ink applicator system is maintained below a predetermined maximum during the priming and purging steps.

According to another embodiment of the present invention, an ink delivery system is provided for supplying ink from an ink supply to a print head via an ink conduit. The system comprises means for priming the print head, means for purging the print head after printing, and means for maintaining backpressure within the system below a predetermined maximum.

According to another embodiment of the present invention, an inkjet printer is provided comprising a print head, the print head having a total ink volume capacity of less than about 0.05 cc's per color, and a manifold adapted to route ink into the print head and out to an ink supply via an ink conduit.

DETAILED DESCRIPTION OF THE EMBODIMENTS

Reference will now be made in detail to exemplary embodiments of the invention. Wherever possible, the same reference numbers will be used throughout the drawings to refer to the same or like parts.

The following description will use the term "backpressure" to generally describe a slight, but negative pressure lower than ambient atmospheric pressure in a portion of an ink delivery device/system (e.g., within a plenum, an ink chamber, a print head, a manifold, an ink conduit, a pump, etc.) as described, for example, in U.S. Pat. No. 5,886,718 "Ink-jet off axis ink delivery system". When properly controlled, this negative pressure, or backpressure, substantially prevents ink drool from the nozzles of a print head and acts to draw ink from an ink supply. This term is not intended to be limiting on the disclosure, but is used to better illustrate features of the present invention, as it would be readily understood to one of ordinary skill in the art.

Figure 1:
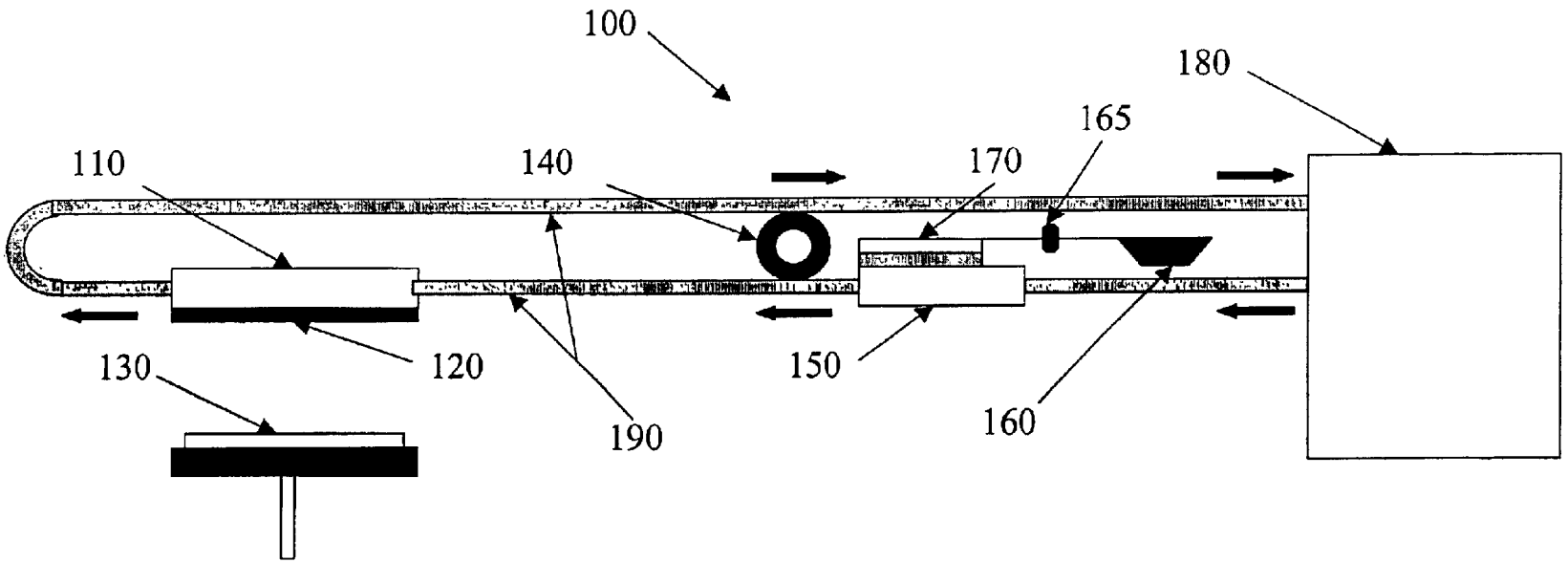
FIG. 1 is a block diagram of an exemplary ink delivery device according to an embodiment of the present invention.

FIG. 1 shows a first embodiment of an ink delivery device 100 for supplying ink from an ink supply 180 to a print head 120 according to the present invention. The ink delivery device 100 is used to supply ink to print head 120 attached to manifold 110, the manifold 110 being adapted to route ink into the print head 120 and then back to the ink supply 180. The manifold 110 ensures that an uninterrupted flow of ink is provided to the print head 120, by preventing the formation of large ink voids from small inconsistencies in the ink delivery (e.g., air bubbles, pump surges, etc.). The ink delivery device 100 comprises a pressure controller 150 operating on an ink conduit 190. The ink conduit 190 extends from the ink supply 180 to the print head 120 and then back to ink supply 180. The pressure controller 150 includes a sealing device 160 adapted to seal off the ink conduit 190 (on the delivery flow path side) between ink supply 180 and print head 120, and a cap 170 adapted to selectably expose the pressure controller 150 to ambient conditions.

A single ink conduit 190 is shown in FIG. 1 with a separated delivery flow path and return flow path. However, other ink conduit configurations are also possible, such as a single delivery/return flow path, multiple delivery flow paths and multiple return flow paths, etc. One or more check valves (not shown) may be provided along the ink conduit 190 to prevent back siphoning depending on the particular system design.

It should be appreciated that the present invention is applicable for both monochrome (i.e., single color) and multicolor applications. In multicolor applications, either a single, multi-chambered, pen is provided (i.e., part of the print head 120 and manifold 110) for all of the colors (e.g., cyan, yellow, magenta, and black), or individual pens are provided for each of the colors. Other variations may be implemented, as would be readily apparent to one of ordinary skill in the art after reading this disclosure.

According to an embodiment of the present invention, the pressure controller 150 comprises a bubbler, such as a filter screen bubbler, a hydrophilic ball bubbler, a piston cylinder bubbler, a holed film bubbler, or other convenient design, as described, for example, in U.S. Pat. No. 5,841,454, "Ink-jet pen gas separator and purge system". Other pressure controllers (including non-bubbler configurations) that exchange air for ink when purging may also be utilized.

Figure 2:
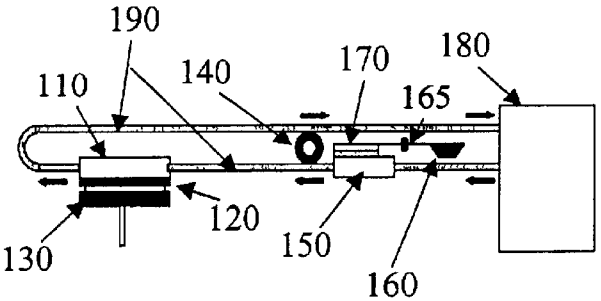
FIG. 2 is a block diagram of the exemplary ink delivery device of FIG. 1 in a fill stage according to an embodiment of the present invention.

As shown in FIG. 1, the sealing device 160 (e.g., a clamp) and the cap 170 can be linked such that when the ink conduit 190 is sealed, the cap 170 is open (e.g., FIG. 3) and when the ink conduit 190 is not sealed, the cap 170 is closed (e.g., FIG. 2). Such a linked configuration can be achieved, for example, by mounting the sealing device 160 and cap 170 on a toggle arm 165. The toggle arm 165 can be configured such that the sealing device 160 and the cap 170 are moved via a service station motor (e.g., a motor that drives such service station motions as moving a prime cap 130 (to be discussed below) and/or wipers (not shown)). Passive methods of actuating sealing device 160 and cap 170 are also possible, as would be readily apparent to one of ordinary skill in the art after reading this disclosure.

The ink delivery device may further comprise in one embodiment a peristaltic pump 140 to circulate ink along the ink conduit 190; an example of such a pump is described in U.S. Pat. No. 4,567,494, "Nozzle Cleaning, Priming and Capping Apparatus for Thermal Ink Jet Printers". As depicted, a single peristaltic pump 140 may be provided to circulate ink from the ink supply 180 to the print head 120, and back from the print head 120 to the ink supply 180 along separate ink conduits 190, or along a single ink conduit. Alternatively, a plurality of peristaltic pumps may be provided if desired. Other non-peristaltic type pumps such as syringe pumps, diaphragm pumps, gear pumps, and piezoelectric pumps may also be used, as would be readily apparent to one of ordinary skill in the art after reading this disclosure.

A prime cap 130 may be provided for use during a priming and/or a purging step as will be described in detail below. Prime cap 130 is adapted to cover at least one nozzle on the print head 120 (e.g., five nozzles are indicated by downward pointing arrows in FIG. 6). Prime cap 130 may include a suction device such as a vacuum source (not shown) to draw ink from the nozzles.

According to one embodiment of the present invention, the manifold 110 is formed from an amorphous material and/or an amorphous/semicrystalline blended material, such as polysulfone (PSU), acrylonitrile butadiene styrene (ABS), polyphenylene ether (PPE)/polypropylene (PP), polyphenylene oxide (PPO)/polypropylene (PP), or other appropriate materials. In general, amorphous materials and amorphous/semicrystalline blended materials tend to allow a significant amount of water evaporation through the materials in comparison to relatively pure semicrystalline materials, but are substantially lower in cost to procure and are easier to fabricate into an assembled product than semicrystalline materials. Alternatively, other materials, such as ceramics, could be used for the manifold 110, as would be readily apparent to one of ordinary skill in the art after reading this disclosure.

According to another embodiment of the present invention, ink supply 180 comprises a semicrystalline material, such as liquid crystal polymer (LCP), polyphenylene sulfide (PPS), polypropylene (PP), polyethylene terephthalate (PET), or other convenient material. As noted above, semicrystalline materials tend to allow less water evaporation through the materials in comparison to amorphous materials and amorphous/semicrystalline blended materials, though they are generally more expensive to procure and more difficult to fabricate into an assembled product. A semicrystalline material may be used for ink supply 180, however, to minimize any water evaporation losses through the ink supply 180, where water vapor evaporation is of greatest concern in the ink delivery device. Hence, material expense and assembly difficulty are traded for improved water evaporation characteristics in the ink supply 180. It should be appreciated, however, that less bonding/attaching to other components is required for ink supply 180 than print head 120, thus the assembly difficulty and cost associated with semicrystalline materials is mitigated somewhat in ink supply 180 in comparison to print head 120. Alternatively, an entire system (including print head 120 and/or manifold 110) could be made of a semicrystalline material, the material chosen for each component being a matter of design choice.

The operation of the aforementioned ink delivery device of FIG. 1 will now be described in detail with reference to FIGS. 2–6. The following description is provided purely for purposes of illustration only, and is not limiting on the scope of the invention. Hence, operation variation is contemplated within a given ink delivery device or amongst differing ink delivery devices according to the present invention.

As shown in FIG. 2, when preparing to print an image, the ink delivery device first fills the print head 120 and manifold 110 with ink. The filling step comprises closing cap 170 over the pressure controller 150 to substantially seal off the ink delivery device from ambient conditions, and positioning the prime cap 130 over the print head nozzles. As the cap 170 is closed over the pressure controller 150, the sealing device 160 opens, allowing for ink flow along ink conduit 190 from the ink supply 180 to the print head 120. The peristaltic pump 140 is then activated to draw ink from the ink supply 180 into the print head 120 and manifold 110. Note that under standard operating conditions, the print head 120 and manifold 110 will be substantially free of ink prior to the filling step and after a purging step as will be described in detail below.

Figure 3:
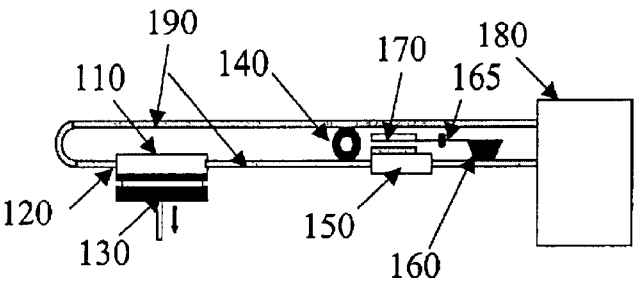
FIG. 3 is a block diagram of the exemplary ink delivery device of FIG. 1 in a charge/prime stage according to an embodiment of the present invention.

As shown in FIG. 3, once the print head 120 and/or manifold 110 is substantially full of ink, the ink delivery device then primes the print head 120 prior to printing. The priming step comprises opening cap 170, thereby exposing the pressure controller 150 to ambient conditions and sealing off the ink conduit 190 between the ink supply 180 and the print head 120 (on the delivery flow path) with sealing device 160. The prime cap 130 is then activated (e.g., opened) to pull enough ink out of the system to raise the backpressure to a controlled pressure (e.g., the bubble point) of the pressure controller 150. Once activated by raising the backpressure, the pressure controller 150 sets an upper level for backpressure in the system and/or a controlled range for backpressure in the system.

Figure 6:
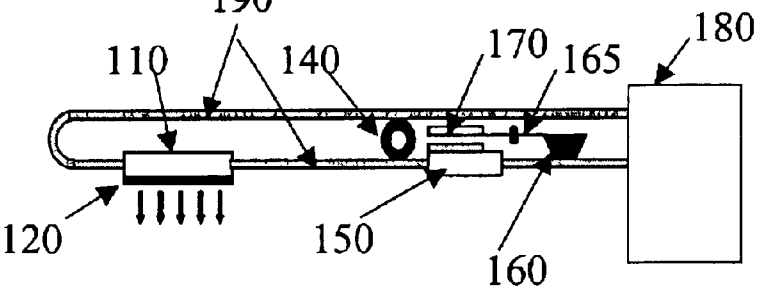
FIG. 6 is a block diagram of the exemplary ink delivery device of FIG. 1 in a print stage according to an embodiment of the present invention.

As shown in FIG. 6, once the system has been primed, the printer is then ready to print. As the system is printing, the pressure controller 150 maintains the back pressure below the controlled pressure of the pressure controller 150, typically within a predetermined range (e.g., substantially within a range of about 7.62 cm $H_2O$ or about 3" $H_2O$). With cap 170 open, air is drawn into the system through pressure controller 150 as ink is printed onto the page. If the print job requires more ink than the primed system contains, the fill and prime steps are repeated as necessary to complete the print job. Typically, the printer is adapted to print on media no larger than about 10.16 cm by about 15.24 cm (i.e., about 4" by about 6"). By way of example, if 0.05 cc's per color is needed as a worst case to be able to accommodate any print job with a reasonable safety buffer of more ink than should be required for the print job, then a 1 mm ID tube between the bubbler and the print head would only need to be 6.36 cm (i.e., about 2.5") long. Hence, the tube diameter and length between the print head can be adjusted to accommodate the desired pumping frequency (and print media size). This example illustrates that 1 pump cycle per printed page is achievable. Also, if the nozzles are capped off during a fill cycle, the prime cycle can be eliminated before the next page is printed, which can save time.

Figure 4:
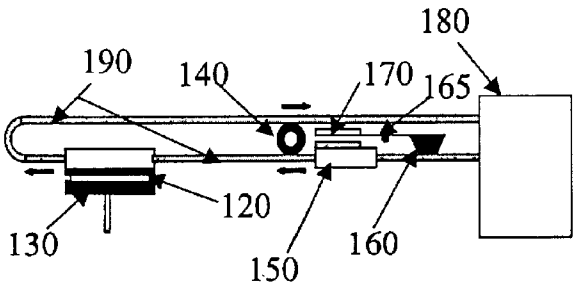
FIG. 4 is a block diagram of the exemplary ink delivery device of FIG. 1 in a first purge stage according to an embodiment of the present invention.
Figure 5:
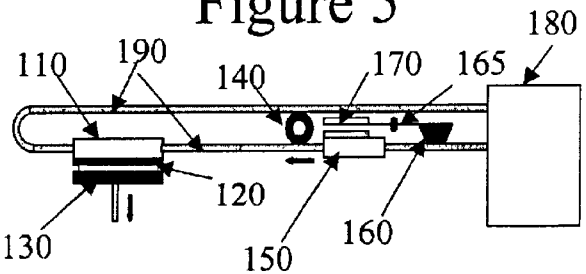
FIG. 5 is a block diagram of the exemplary ink delivery device of FIG. 1 in a second purge stage according to an embodiment of the present invention.

As shown in FIG. 4, after printing is complete, the ink delivery device is purged of ink. The prime cap 130 is closed over the nozzles, and sealing device 160 seals off the ink conduit 190. Cap 170 is opened to expose the pressure controller to ambient conditions, and the peristaltic pump 140 is activated, thereby returning ink from the print head 120 and/or manifold 110 back to ink supply 180 and drawing air into the ink delivery device via pressure controller 150. A final activation of the prime cap 130 (FIG. 5) will substantially draw any remaining ink from the print head 120.

The aforementioned steps may be repeated as necessary before, during, and/or after a given print job. For example, the priming and/or purging steps may be repeated during a print job to remove ink inconsistencies (e.g., ink voids, air bubbles, ink impurities, etc.) as necessary. Furthermore, the ink fill step may be repeated if necessary to refill the print head 120 with ink. Thus, it should be appreciated that may variations are plausible amongst the aforementioned steps.

Experiments conducted with the above described method and apparatus will now be described in reference to FIGS. 7–12. The following description is provided purely for purposes of illustration only, and is not limiting on the scope of the invention. Hence, experimental result variation is entirely possible amongst differing ink delivery devices according to the present invention.

Figure 7:
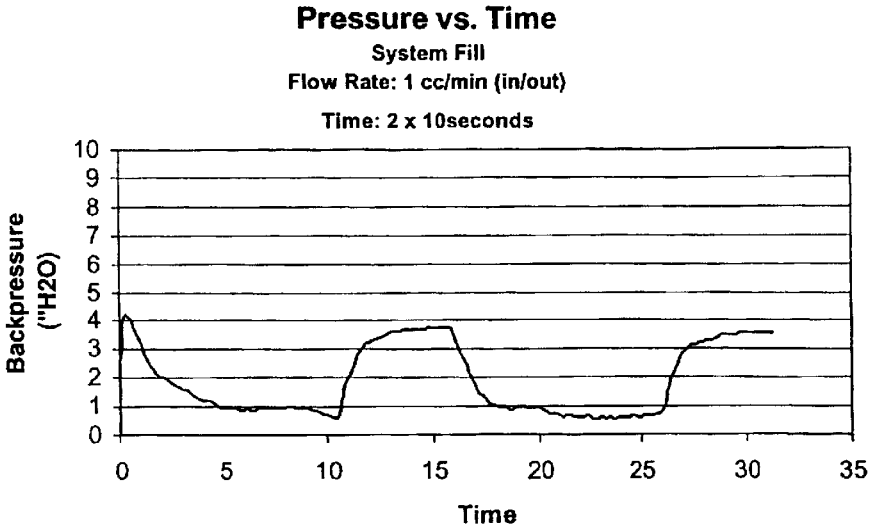
FIG. 7 is a graph depicting backpressure versus time for a fill stage according to an embodiment of the present invention.

A graph depicting backpressure versus time for a fill stage according to an embodiment of the present invention is shown in FIG. 7. The experiment depicted started out with the print head 120 and manifold 110 empty. Syringe pumps supplying ink into and out of the print head 120 and manifold 110 and were run at substantially the same rate of about 1 cc/min in two 10 second cycles. After each 10 second cycle, there was a 5 to 6 second reset cycle for the syringe pumps.

The graph of FIG. 7 shows that the pressure in the system tends towards a positive pressure during the initial seconds of the cycle and levels out at about 2.54 cm (i.e., about 1" $H_2O$). The pressure in the system can be improved by operating the pump 140 which supplies ink to the print head 120 from the ink supply 180 at a slower rate than the pump returns ink to the ink supply 180 from the print head 120 (e.g., at about a 10% lower rate). Different flow rates can be achieved with a peristaltic pump, for example, by changing the inside diameters of the tubes routed through the pump. Ink pumping speed variation can also improve initial system charging as well. By way of example, the system of FIG. 2 without the ink supply 180 can be considered a control volume. One tube is flowing into the system and one tube is flowing out of the system. In the case of a peristaltic pump, if the cross sectional area of-the tube flowing in through the pump equals the cross sectional area of the tube flowing out through the pump, then when the pump rotates (i.e., in the case of a peristaltic pump), the flow in will equal the flow out. If the cross sectional area of the tube flowing out is larger than the cross sectional area of the tube flowing in, then when the pump rotates, the system will be trying to pump out more than it is able to pump in. A pressure differential will result which can be limited by adding a bubbler into the system that will allow air to flow into the control volume to replace the extra ink that is being pumped out when the bubble point of the bubbler is reached. If the system continues to pump in this manner, it will end up with air and ink in the control volume at the negative pressure established by the bubbler. This results in "charging" the system or setting its initial negative pressure. Another way to achieve a charging effect without varying the cross sectional area of the tube is to close the inlet with a sealing device 160, as shown in FIG. 4. The volume flowing in won't equal the volume flowing out, but the bubbler will be enabled such that air can be exchanged for ink when the negative pressure in the system reaches the bubble point of the bubbler or pressure controller 150. In both of these examples, some fine tuning may be required to optimize the time to pump before the bubble point of the bubbler is reached, such that minimal air is ingested during this process.

Figure 8:
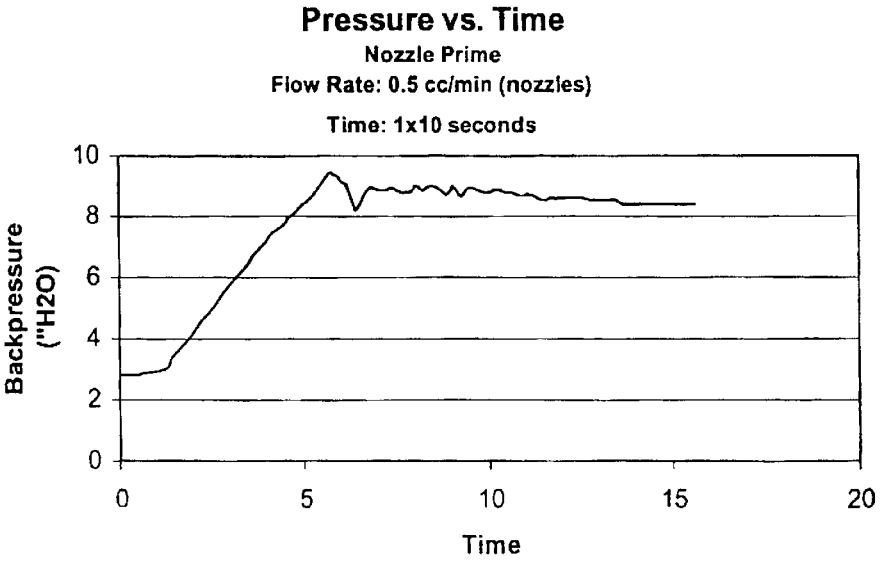
FIG. 8 is a graph depicting backpressure versus time for a charge/prime stage according to an embodiment of the present invention.

A graph depicting backpressure versus time for a charge/prime stage according to an embodiment of the present invention is shown in FIG. 8. The charge/prime cycle was run to bring the backpressure in the system up to the bubblepoint of a filter screen bubbler (i.e., one type of pressure controller 150). As can be seen in FIG. 8, a bubble pressure of around 22.86 cm $H_2O$ (i.e., around 9" $H_2O$) was reached after about 6 seconds. The flow rate was 0.5 cc/min through the nozzles; hence, the amount of ink removed from the system for charging/priming was about 0.05 cc's.

Figure 9:
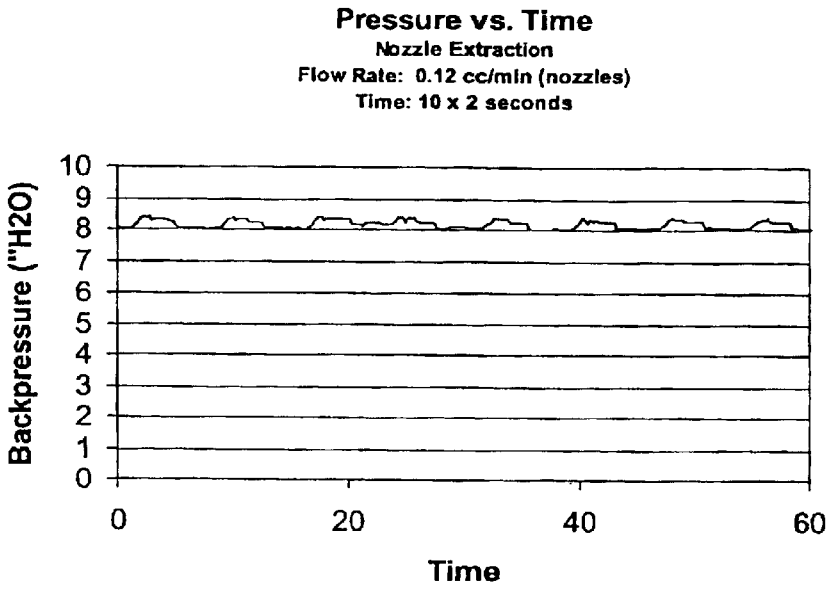
FIG. 9 is a graph depicting backpressure versus time for a print stage according to an embodiment of the present invention.

A graph depicting backpressure versus time for a print stage according to an embodiment of the present invention is shown in FIG. 9. A flow rate of 0.12 cc/min was used to simulate printing. Ten 2 second print cycles were run. As shown in FIG. 9, the pressure in the system was bounded by the bubble pressure of the filter screen bubbler at about 22.86 cm $H_2O$ (i.e., about 9" $H_2O$). With no recirculation flow rate, the backpressure range is approximately 1.27 cm $H_2O$ (i.e., approximately 0.5" $H_2O$). As recirculation flow is introduced into the system, the backpressure range increases to approximately 5.08 cm $H_2O$ (i.e., approximately 2" $H_2O$) at 1 cc/min of recirculation flow. As can be seen in FIG. 9, a non-continuous ink supply was utilized for the print stage. Alternatively, a continuous ink supply could be used, as would be readily apparent to one of ordinary skill in the art.

Figure 10:
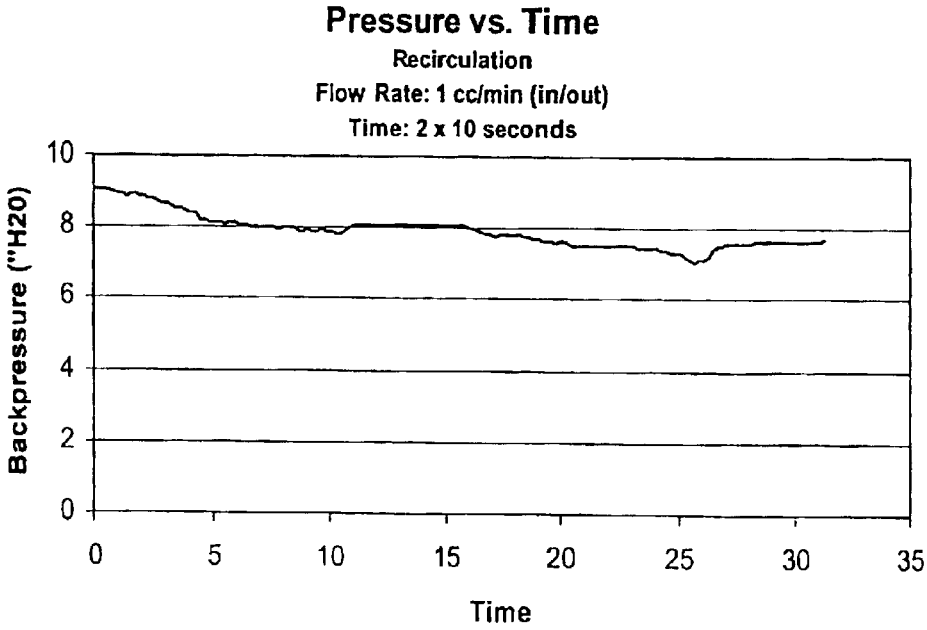
FIG. 10 is a graph depicting backpressure versus time for a recirculation stage according to an embodiment of the present invention.

A graph depicting backpressure versus time for a recirculation stage according to an embodiment of the present invention is shown in FIG. 10. The recirculation stage corresponds to refilling the print head 120 and/or manifold 110 during printing. Substantially the same conditions were used for the recirculation cycle as were used for the fill cycle. As shown in FIG. 10, the recirculation cycle decreased the backpressure in the system, which may require a charge/prime cycle before printing again unless the pump supplying ink to the print head 120 from the ink supply 180 is set at a slower rate than the pump returns ink to the ink supply 180 from the print head 120.

Figure 11:
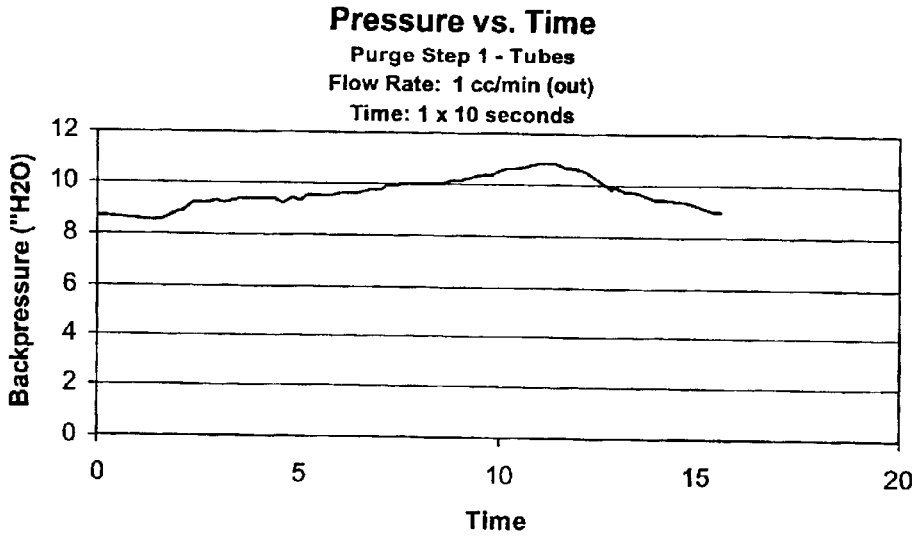
FIG. 11 is a graph depicting backpressure versus time for a first purge stage according to an embodiment of the present invention.

A graph depicting backpressure versus time for a first purge stage according to an embodiment of the present invention is shown in FIG. 11. The pump pulling ink out of the system was set to 1 cc/min to pull ink out of the system and bubble air into the system. As shown in FIG. 11, the flow rate of ink out is greater than the flow rate of air bubbling in, as the pressure in the system increases above the bubble point of the bubbler (i.e., about 22.86 cm $H_2O$ or about 9" $H_2O$). This relationship can be optimized by adjusting the rate difference between the pump supplying ink to the print head 120 from the ink supply 180 and the pump returning ink to the ink supply 180 from the print head 120.

Figure 12:
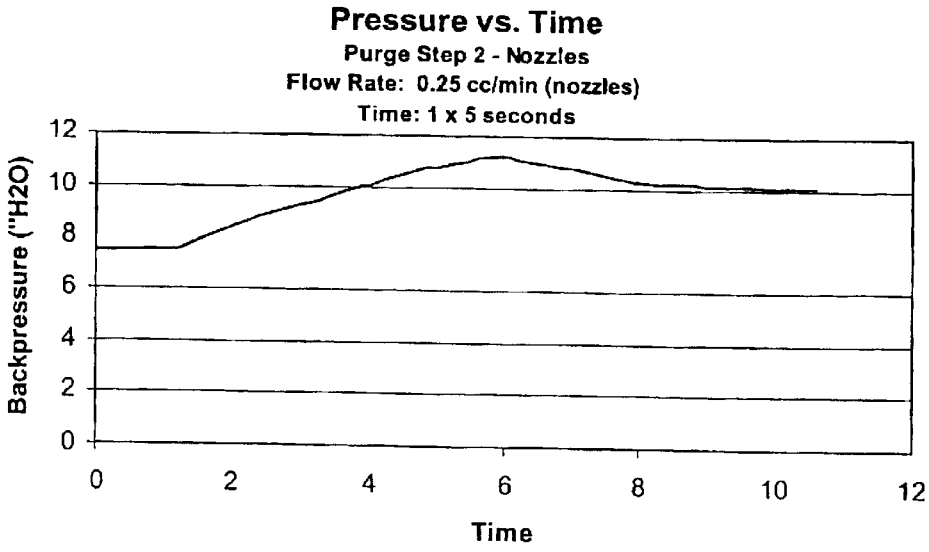
FIG. 12 is a graph depicting backpressure versus time for a second purge stage according to an embodiment of the present invention.

A graph depicting backpressure versus time for a second purge stage according to an embodiment of the present invention is shown in FIG. 12. As noted above, a second purge stage can be used to remove any ink remaining in the nozzles, feed slot, and/or manifold 120 by means of the prime cap 130. As shown in FIG. 12, not all of the ink was removed from the aforementioned devices, as the backpressure continued to climb through the duration of the prime and leveled off. The experiment was able to clear about 99% of the ink in the system, but was unable to clear ink out of the nozzles because the negative pressure in the system never reached the bubble point of the nozzles (i.e., about 50.8 or about 20" $H_2O$). Hence, the graph shows that the pump was only running at a rate that raised the negative pressure to around 27.94 cm $H_2O$ (i.e., around 11" $H_2O$) before the pump was turned off. One method of clearing out the remaining ink in the firing chambers would be to fire the nozzles briefly, which would pump the ink out of the nozzles and into the prime cap.

An ink delivery device according to the aforementioned embodiments provides one or more substantial advantages over conventional devices. By introducing active air management (e.g., through use of a pump 140 and a pressure controller 150), the ink within the system can be more accurately controlled to optimized levels in small chambers, thereby improving the performance and consistency of ink application via the print head. This facilitates high performance printers with relatively small pen sizes (e.g., print head having a total ink volume capacity of less than about 0.05 cc's per color for single or multi-color printer applications).

Furthermore, the ink purging and priming of the print head 110 allows for printers without high vapor or air barrier materials (e.g., semicrystalline materials) in the pen and/or tubes. Thus, a lower cost and less complex printer can be designed with performance that meets or exceeds that of conventional printers.

The inventor has also discovered that it is advantageous in one embodiment to store the ink in a large central reservoir if possible (or one central reservoir per color in a multi-color printer) to take advantage a lower effect on ink quality if a given amount of water vapor evaporates from a central large volume of ink (i.e., a central reservoir) compared to the same amount of water vapor evaporating from individual small volumes of ink (e.g., ink cavities behind each nozzle). Moreover, the use of costly materials (e.g., semicrystalline materials) and/or vapor barriers can be minimized by focusing high cost, evaporation resistant materials for use in the central reservoir(s), rather than in every component in a given printer. Thus, a separated ink supply/print head configuration can provide substantial advantages over conventional integrated cartridge configurations.

Hence, the present disclosure provides for an improved ink delivery system, and in particular, for an improved ink delivery system that especially facilitates use of miniature pen designs.

It should be noted that although the description provided herein recites a specific order of method steps, it is understood that the order of these steps may differ from what is described and/or depicted. Also two or more steps may be performed concurrently or with partial concurrence. Such variation will depend on the systems chosen, and more generally on designer choice. It is understood that all such variations are within the scope of the invention.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

What is claimed is:

1. An ink delivery device for supplying ink via an ink conduit from an ink supply to a print head attached to a manifold, the manifold adapted to route ink into said print head and back to the ink conduit for routing to the ink supply, the ink delivery device comprising:

a pressure controller operating on the ink conduit between the print head and the ink supply, said pressure controller including a sealing device adapted to seal off the ink conduit and a cap adapted to selectably expose the pressure controller to ambient conditions, wherein said pressure controller is adapted to purge the print head of ink between print jobs.

2. The ink delivery device of claim 1, wherein the sealing device comprises a clamp.

3. The ink delivery device of claim 1, wherein the sealing device and the cap are linked such that when the ink conduit is sealed, the cap is open and when the ink conduit is not sealed, the cap is closed.

4. The ink delivery device of claim 3, wherein the sealing device and the cap are linked via a toggle arm.

5. The ink delivery device of claim 3, wherein the sealing device and the cap are moved via a service station motor.

6. The ink delivery device of claim 1, wherein the pressure controller comprises one of a filter screen bubbler, a ball cylinder bubbler, a piston cylinder bubbler, and a holed film bubbler.

7. The ink delivery device of claim 1, wherein backpressure in the ink delivery device is bounded by bubble pressure of the pressure controller.

8. The ink delivery device of claim 7, wherein the pressure controller maintains the backpressure in the ink delivery device substantially within a range of about 7.62 cm $H_2O$.

9. The ink delivery device of claim 1, further comprising: a peristaltic pump to circulate ink along said ink conduit.

10. The ink delivery device of claim 9, wherein the peristaltic pump supplies ink to the print head from the ink supply at a slower rate than the pump returns ink to the ink supply from the print head.

11. The ink delivery device of claim 10, wherein the peristaltic pump supplies ink to the print head from the ink supply at a rate about 10% lower than the pump returns ink to the ink supply from the print head.

12. The ink delivery device of claim 9, wherein the peristaltic pump is configured to provide a non-continuous supply of ink to the print head.

13. The ink delivery device of claim 1, further comprising:

a prime cap adapted to cover at least one nozzle on said print head.

14. The ink delivery device of claim 1, wherein the manifold comprises one of an amorphous material and an amorphous/semicrystaline blended material.

15. The ink delivery device of claim 14, wherein the manifold comprises one of polysulfone (PSU), acrylonitrile butadiene styrene (ABS), polyphenylene ether (PPE)/polypropylene (PP), and polyphenylene oxide (PPO)/polypropylene (PP).

16. The ink delivery device of claim 1, wherein the ink supply comprises a semicrystalline material.

17. The ink delivery device of claim 16, wherein the ink supply comprises one of liquid crystal polymer (LCP), polyphenylene sulfide (PPS), polypropylene (PP), and polyethylene terephthalate (PET).

18. A method of delivering ink to an ink applicator system including an ink applicator, comprising the steps of:

priming the ink applicator prior to printing; and purging the system after printing to remove ink from the ink applicator system, wherein a backpressure within the ink applicator system is lowered to a predetermined maximum backpressure during said priming step, said predetermined maximum backpressure being controlled to be different from a backpressure maintained during printing.

19. The method of claim 18, wherein the backpressure is maintained substantially at 3 inches $H_2O$ during printing.

20. A method of delivering ink to an ink applicator system including an ink applicator, comprising the steps of:

priming the ink applicator prior to printing;

purging the system after printing to remove ink from the ink applicator system; and supplying the ink applicator with ink, the supplying step comprised of:

closing a bubbler cap located along an ink conduit from an ink supply to the ink applicator;

covering at least one ink applicator nozzle with a prime cap; and pumping ink from the ink supply to the ink applicator, wherein the backpressure within the ink applicator system is maintained below a predetermined maximum during said priming and purging steps.

21. A method of delivering ink to an ink applicator system including an ink applicator, comprising the steps of:

priming the ink applicator prior to printing; and purging the system after printing to remove ink from the ink applicator system, wherein the backpressure within the ink applicator system is maintained below a predetermined maximum during said priming and purging steps, and wherein the priming step comprises:

opening a bubbler cap located along an ink conduit from an ink supply to the ink applicator;

sealing off the ink conduit; and removing a sufficient amount of ink from the system to raise the system back pressure to the bubble point of a bubbler including said bubbler cap.

22. The method of claim 21, wherein the removing step removes ink at a rate of less than about 0.5 cc/min.

23. A method of delivering ink to an ink applicator system including an ink applicator, comprising the steps of:

priming the ink applicator prior to printing; and purging the system after printing to remove ink from the ink applicator system, wherein the backpressure within the ink applicator system is maintained below a predetermined maximum during said priming and purging steps, and wherein the purging step comprises:

covering at least one ink applicator nozzle with a prime cap;

clamping an ink conduit from an ink supply to the ink applicator, drawing ink from the system into the ink supply with a pump; and drawing air into the system through a bubbler.

24. The method of claim 23, wherein the purging step further comprises: drawing ink from the ink applicator into the ink supply with the prime cap.

25. An ink delivery system for supplying ink from an ink supply to a print head via an ink conduit, the system comprising:

means for priming said print head;

means for purging said print head after printing; and means for maintaining backpressure within said system below at a predetermined maximum backpressure during priming of said print head, wherein the predetermined maximum backpressure is controlled to be different from a backpressure maintained during printing.

26. The ink delivery system of claim 25, wherein the backpressure during printing is maintained at about 3 inches $H_2O$.

27. An inkjet printer, comprising:

a print head, said print head having a total ink volume capacity of less than about 0.05 cc's per color; and a manifold configured to route ink into said print head and out to an ink supply via an ink conduit.

28. The inkjet printer of claim 27, wherein said print head is configured to print only one color.

29. The inkjet printer of claim 27, wherein said manifold is configured to route ink into said print head and out to said ink supply at an average flow rate of less than 0.12 cc's per minute per color.

30. The inkjet printer of claim 27, wherein the manifold comprises one of an amorphous material and an amorphous/semicrystaline blended material.

31. The inkjet printer of claim 30, wherein the manifold comprises one of polysulfone (PSU), acrylonitrile butadiene styrene (ABS), polyphenylene ether (PPE)/polypropylene (PP), and polyphenylene oxide (PPO)/polypropylene (PP).

32. The ink delivery device of claim 1, further comprising a pump to circulate ink along said ink conduit.

33. The ink delivery device of claim 32, wherein the pump is a peristaltic pump.

34. The ink delivery device of claim 32, wherein the pump is on of a peristaltic pump, syringe pump, diaphragm pump, and piezoelectric pump.

35. A method of claim 32, wherein the predetermined maximum backpressure corresponds to a bubble point of the pressure controller which controls the backpressure.

36. An inkjet printer of claim 27, wherein the ink conduit leads from an ink supply to the manifold and from the manifold back to the ink supply via a pump, and wherein the pump is configured to induct from the manifold and discharge toward the ink supply.

37. An inkjet printer of claim 36, wherein a pressure controller is disposed in the conduit between the manifold and the ink supply, the pressure controller being configured to selectively introduce air into the conduit to permit ink to be purged from the conduit and manifold.

* * * * *

UNITED STATES PATENT AND TRADEMARK OFFICE

CERTIFICATE OF CORRECTION

PATENT NO. : 6,742,861 B2
DATED : June 1, 2004
INVENTOR(S) : McCarty

It is certified that error appears in the above-identified patent and that said Letters Patent is hereby corrected as shown below:

Column 11,
Line 36, delete “below”.

Column 12,
Line 26, delete “on” and insert therefor -- one --.
Line 28, delete “claim 32,” and insert therefor -- claim 18, --.

Signed and Sealed this

Fifteenth Day of February, 2005

JON W. DUDAS
*Director of the United States Patent and Trademark Office*